US007140892B2

(12) United States Patent
Takeuchi

(10) Patent No.: US 7,140,892 B2
(45) Date of Patent: Nov. 28, 2006

(54) ELECTRICAL CONNECTOR HAVING SHUTTER

(75) Inventor: Yousuke Takeuchi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/244,203

(22) Filed: Oct. 6, 2005

(65) Prior Publication Data

US 2006/0141833 A1 Jun. 29, 2006

(30) Foreign Application Priority Data

Dec. 28, 2004 (JP) ..... 2004-378342

(51) Int. Cl.
*H01R 13/44* (2006.01)

(52) U.S. Cl. ..... 439/138

(58) Field of Classification Search ..... 439/138, 439/142, 660; 385/78
See application file for complete search history.

(56) References Cited

U.S. PATENT DOCUMENTS 5,093,887 A * 3/1992 Witte ..... 385/135
5,997,319 A 12/1999 Wu
6,206,577 B1 * 3/2001 Hall et al. ..... 385/53
6,685,362 B1 * 2/2004 Burkholder et al. ..... 385/78
6,887,086 B1 * 5/2005 Kuroki ..... 439/138
2001/0031570 A1 10/2001 Horikoshi et al.
2003/0077929 A1 4/2003 Funatu
2004/0067667 A1 4/2004 Kuroki

FOREIGN PATENT DOCUMENTS

EP 1418650 12/2004
FR 2723268 2/1996
JP 2004-71400 3/2004

* cited by examiner

*Primary Examiner*—Phuong Dinh
(74) *Attorney, Agent, or Firm*—Takeuchi & Kubotera, LLP

(57) ABSTRACT

An electrical connector (10) having a shutter (50) at an opening provided on a front side thereof for plug-in with a mating connector (60) includes a housing (21), a shield case (30) made of a sheet metal and fixed to an outside of the housing (21), at least one shutter member (51 and 52) for opening and closing the opening of the electrical connector (10) and having a lid (53, and 54) moving to an open position of the shutter (50) when the mating connector (60) pushes the lid (53 and 54) during the plug-in, and a pair of bias member (40) for biasing the shutter member (51 and 52) to a closed position of the shutter (50), wherein each of the bias members (40) comprises at least one resilient arm (42) of a plate-type spring made as one body with the shield case (30).

11 Claims, 8 Drawing Sheets

ELECTRICAL CONNECTOR HAVING SHUTTER

BACKGROUND OF THE INVENTION

1. Field of the Invention

This invention relates to an electrical connector having a shutter.

2. Description of the Related Art

An electrical connector has an opening for plug-in connection with a mating connector. The electrical connector is usually provided with a shutter on the opening to prevent dust from entering the opening from the outside when the mating connector is not connected with the electrical connector for a long time. When the mating connector is plugged in the connector, the mating connector pushes and moves the shutter in an opening direction.

An example of such an electrical connector having a shutter is disclosed in, for example, Japanese Patent Application Kokai No. 2004-71400. An opening of the electrical connector has a rectangular shape with the width greater than the height. Lids of two shutter members move upwards and downwards in opposite directions to open or close the opening. The two shutter members are made of synthetic resin and have rotating arms, on the sides thereof, which are rotatably supported by shafts provided in a housing having a shell (a shield case). The rotating arms are provided with helical torsion coil springs to bias the shutter members in a closed direction. The corresponding edges of the lids of the two shutter members abut against each other to close the opening. When an induction part provided on the lids is pushed by the mating connector, the shutter members surmount the bias force of the coil spring and move in the opening direction to enable the plug-in with the mating connector.

However, the above conventional connector requires the helical torsion coil spring so that the manufacturing cost increases, the assembly is complicated, the connector becomes large, and it is difficult to secure the strength of the shutter member.

Firstly, the connector requires the coil spring as well as the shutter members, the stock and management of necessary parts and assembly thereof become complicated. It is well known that the handling of the helical torsion coil spring during the assembly is troublesome.

Secondly, in the above conventional connector, a groove having a plane shape of C is formed to accommodate the shaft which rotatably supports the rotating arm of the shutter member. The shaft has the coil spring to bias the rotating arm. Consequently, a large space is required in an axis direction of the shaft to provide the coil spring. Consequently, the connector becomes large in a widthwise direction thereof.

SUMMARY OF THE INVENTION

Accordingly, an object of this invention is to provide an electrical connector having a shutter capable of reducing the manufacturing cost by making small the connector and simplifying the structure of the connector, and making easy the handling and assembly of the connector.

According to an aspect of the present invention, an electrical connector having a shutter at an opening provided on a front side thereof for plug-in with a mating connector comprises a housing, a shield case made of a sheet metal and fixed to an outside of the housing, at least one shutter member for opening and closing the opening of the electrical connector and having a lid moving to an open position of the shutter when the mating connector pushes the lid during the plug-in, and a pair of bias members for biasing the shutter member to a closed position of the shutter, wherein each of the bias members comprises at least one resilient arm of a plate-type spring made as one body with the shield case.

In the electrical connector, the bias member is made as the resilient arm of a plate or leaf spring and integrally formed with the shield case as one body. That is, since the resilient arm is integrally made with the shield case as a bias member, the bias member is not made as a separate member independently, thus reducing the number of necessary parts and simplifying the assembly work.

In the present invention, the resilient arm extends forwardly along a side wall of the housing from an rear end of the shield case through a connection portion, and the shutter member comprises the lid provided at a position corresponding to the opening and at least one rotating arm extending backwardly along the side wall of the housing from sides of the lid, wherein the rotating arm is rotatably supported by a rotation support portion provided on the housing or the shield case, and wherein an abutting portion provided at a free end or in the vicinity of the free end of the resilient arm abuts against the rotation arm at a forward position of the rotation support portion to bias the rotation arm to the closed position.

In this case, it is desirable that the abutting portion of the resilient arm has a cut-off groove and the rotation arm of the shutter member has an abutted portion on an upper or a lower edge thereof such that the abutted portion is put in the cut-off portion to prevent a shift and run-off of the rotation arm in a side direction with respect to a right rotation locus.

It is preferred that the resilient arm comprises a curved portion, which is curved in a thicknesswise direction of the resilient arm to promote a resilient flexibility of the resilient arm. With this structure, the dimension of the resilient arm is made small in a direction of the extension of the resilient arm and sufficient resilient force is secured.

It is preferred that the abutted portion of the rotation arm has a slope inclining, in a range where the abutting portion abuts against the abutted portion during a rotation of the rotation arm, toward the closed position of the shutter. With this structure, even if the shutter member is opened up to the predetermined open position, the deformation of the resilient arm is not increased, the stress of the resilient arm is controlled, and the fatigue plastic deformation is prevented despite of repeated deformations.

In the invention, the shield case has guide portions extending forwardly and then inclining outwardly, and the lid of the shutter member has a slope tilting toward an inside of the opening and cut-off portions provided on sides thereof, wherein the guide portions projecting from the cut-off portions forwardly so that the guide portions and the slope work together for guiding the mating connector to be plugged in the electrical connector at the closed position of the shutter.

It is preferred that the housing or the shield case comprises at least one open position control portion to control the maximum opening degree of the shutter member. The mating connector is not always plugged in at the right position and posture. When the mating connector is plugged in on undesirable conditions, the open position control portion prevents an excessive opening of the shutter member, thus preventing a damage of the shutter member.

When the housing or the shield case comprises at least one closed position control portion to abut against the shutter member, the closed position of the shutter member is fixed constantly.

It is desirable that the shutter member is made by processing a sheet metal. Since the metal shield case shields the opening, the shielding of the connector is completely achieved with the work of the shield case. Also, the shutter member is made small (thin) and strengthen. In the present invention, the quantities of the shutter member and the corresponding rotation arm are two, respectively, but they may be one, respectively.

The present invention can be applied to an electrical connector having a separate shield case and bias member or an electrical connector having no shield case. In this case, an electrical connector having a shutter at an opening provided on a front side thereof for plug-in with a mating connector comprises at least one shutter member for opening and closing the opening of the electrical connector and having a lid moving to an open position of the shutter when the mating connector pushes the lid during the plug-in, and a pair of bias members for biasing the shutter member to a closed position of the shutter, wherein each of the bias members comprises a fixed member fixed to a housing or a member fixed to the housing, and at least one resilient arm of a plate-type spring is made as one body with the fixed portion.

As described above, according to the present invention, since the bias member for biasing the shutter member to the closed position is made integrally with the housing or the fixed portion fixed to the housing. That is, the bias member is made as one body with another member. Consequently, since the coil spring member used conventionally is not necessary, the manufacturing cost is reduced and the assembly work is easy. Also, since no special member and space are required for supporting the bias member, the connector is made small.

DESCRIPTION OF THE PREFERRED EMBODIMENT

Embodiments of this invention will now be described below with reference to the accompanying drawings.

First Embodiment

Figure 1:
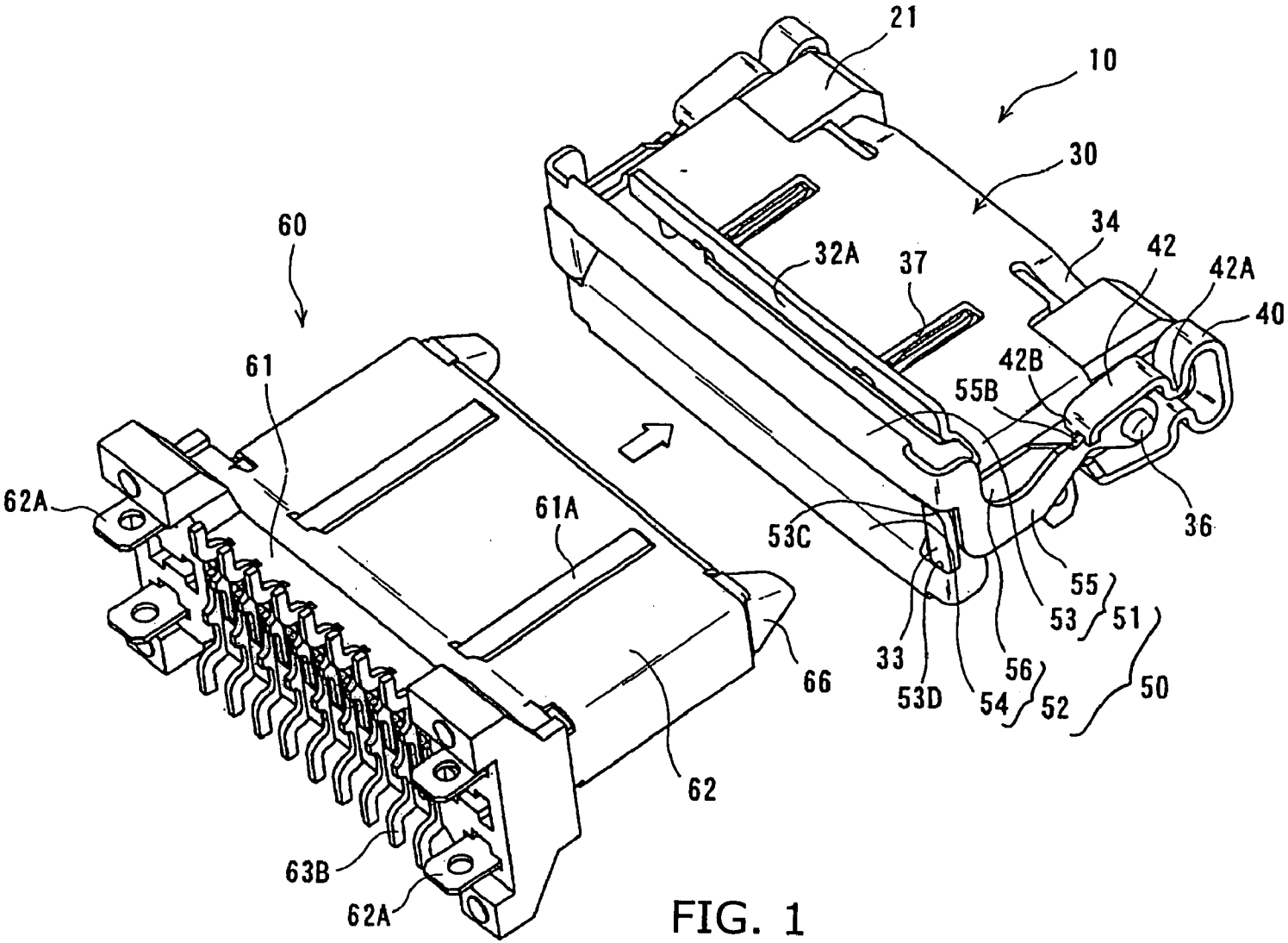
FIG. 1 is a perspective view of an electrical connector and a mating connector according to the first embodiment of the present invention.

In FIG. 1, reference numeral 10 denotes an electrical connector according to this invention and reference 60 denotes a mating connector which is plugged in and connected to the electrical connector 10. The connector 10 comprises, as shown in FIGS. 1, 3(A), 3(B), 5(A) and 5(B), a connector body 20 having an insulating housing 21 and a plurality of terminals 22 held by the housing 21, a shield case 30 made of a sheet metal and fixed to the housing body 20, a bias member 40 formed integrally with the shield case 30, and a shutter 50 made of a sheet metal.

Figure 5A:
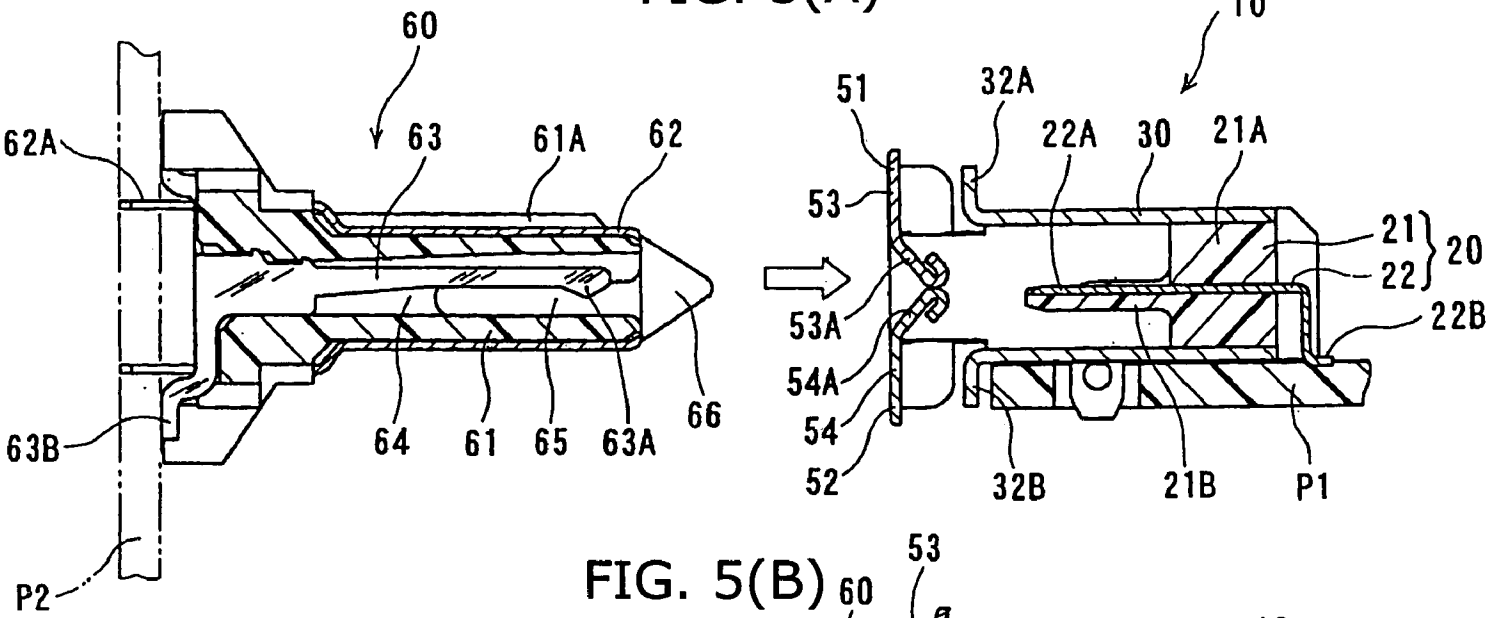
FIGS. 5(A) and 5(B) are sectional views of the electrical connector and the mating connector of FIG. 1 before and after a plug-in of both the connectors, respectively.
Figure 5B:
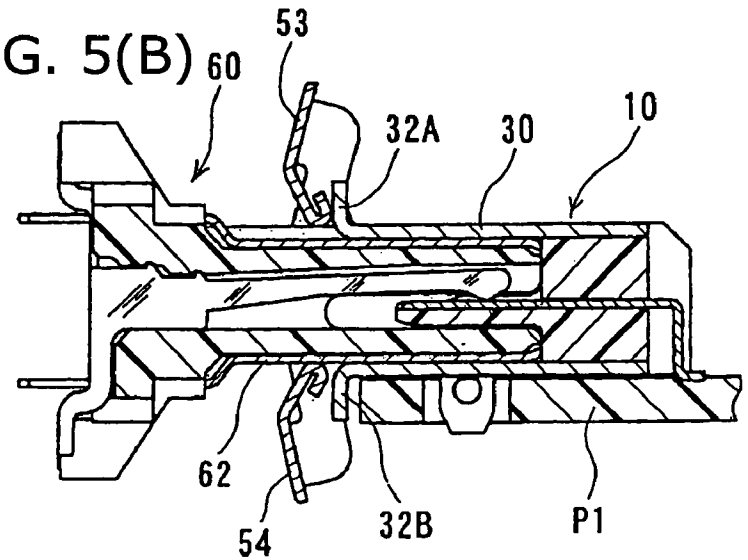

In FIG. 5(A), the connector body 21 has a holding portion 21A for holding the shield case 30 and an arrangement portion 21B of a plane shape extending from the holding portion 21A in a forward direction (to the left in FIG. 5(A)) and in a direction perpendicular to the drawing sheet. The terminal 22 is a stripe having a shape of a crank, and an intermediate part thereof is pressed into and held in the holding portion 21A of the housing 21. The terminal 22 has a contact portion 22A in the front part thereof, which is placed on the upper surface of the arrangement portion 21B, and a connection portion 22B in the rear part thereof, which projects to the outside of the housing 21 and bent downwardly and sideways to substantially flush with the bottom of the housing body 20. A plurality of the terminals 22 are arranged at a predetermined interval in a direction perpendicular to the drawing sheet. As described above, the shield case 30 and the bias member 40 are fixed on the outer surface of the housing 21 and the shutter 50 is rotatably supported by the shield case 30.

Figure 2:
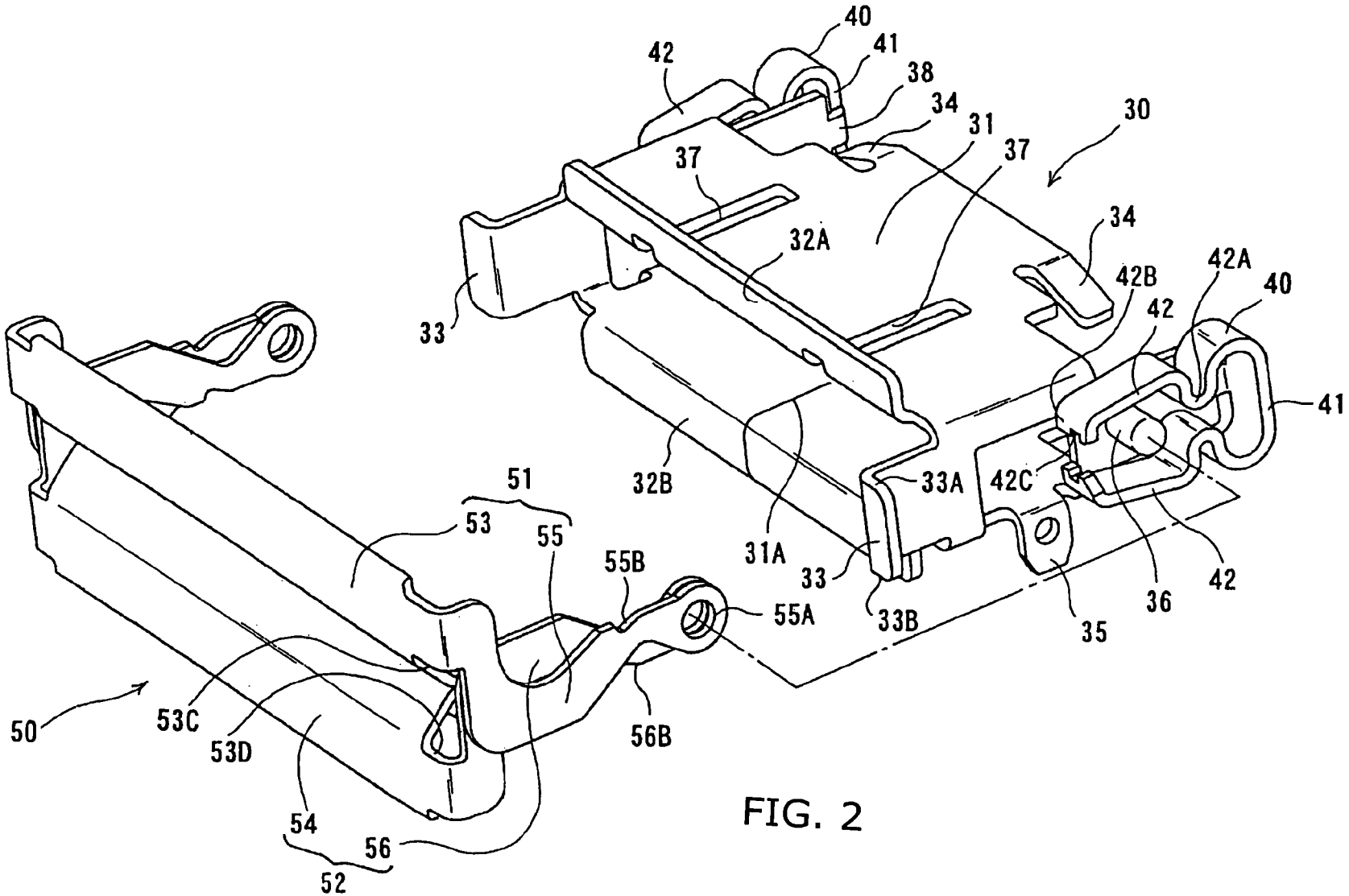
FIG. 2 is an exploded perspective view of a shield case with a bias member and a shutter, which are both installed on the electrical connector.
Figure 3A:
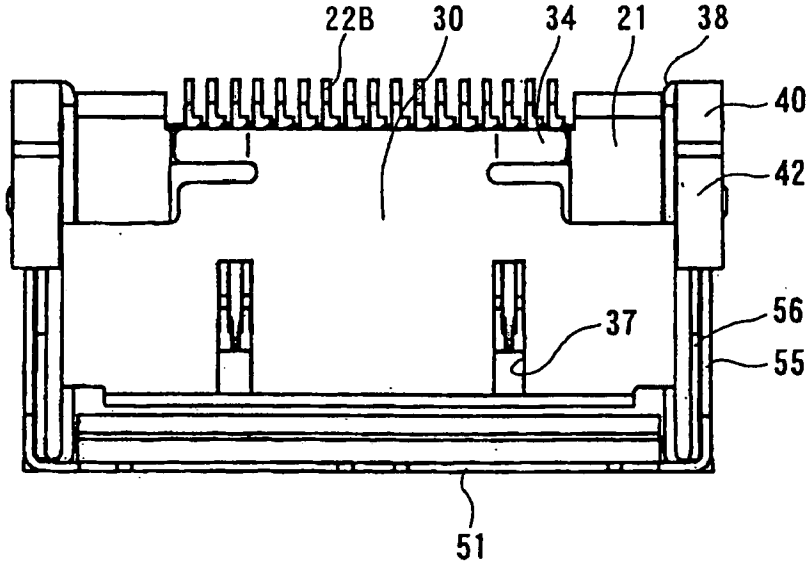
FIGS. 3(A), 3(B), and 3(C) are a top view, a front view, and a side view of the electrical connector of FIG. 1, respectively.
Figure 3B:
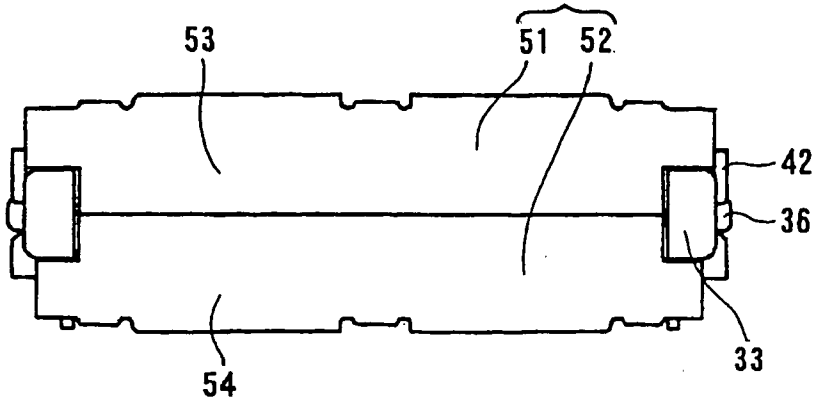
Figure 3C:
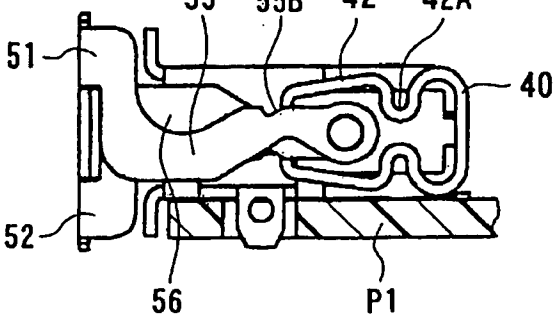

As shown in FIG. 2, the shield case 30 is made of a sheet metal integrally with the bias member 40 as one semi-assembly. As shown in FIGS. 1 and 2, the shield case 30 comprises a rectangular case 31 encircling the housing 21, upper and lower open-position stopping portions 32A and 32B extending outwardly from a front opening of the rectangular case 31, guide portions 33 extending forwardly from the left and right edges of the front opening and then bent slantwise outwardly, a pair of attachment portions 34 projecting sideways from an upper rear end of the rectangular case 31, a pair of fixed legs 35 extending downwardly from lower left and right side edges of the rectangular case 31, and shaft portions 36 projecting outwardly from left and right side walls of the rectangular case 31 at the rear position of the rectangular case 31 to work as rotation support portions. The rectangular case 31 is bent to surround the housing 21 and edges 31A are joined to each other at the bottom of the rectangular case 31. Two guide grooves 37 extend backwardly from the upper stop portion 31A on the upper face of the rectangular case 31.

The open-position stopping portions 32A and 32B abut against, at the open position of the shutter 50, upper and lower shutter members 51 and 52, which constitute the shutter 50, to control the maximum open degrees of the shutter members 51 and 52. The guide portions 33 guide the plug-in of the mating connector with a slope thereof and upper and lower edges thereof work as closed-position control portions 33A and 33B, which abut against the upper and lower shutter members 51 and 52, respectively, to control the excessive external force at the closed-position of the shutter 50. Thus, the mating connector is guided and connected smoothly.

The shield case 30 has a junction portion 38 at the rear end of the side wall, which is connected with the bias member 40. The bias member 40 comprises a base portion 41 having a shape of substantially C and two resilient arms 42 extending forwardly from the upper and lower ends of the base portion 41 along the side wall of the housing 21 up to the intermediate position of the side wall. The two resilient arms 42 face to each other vertically and each of the resilient arms 42 has a curved portion 42A around the boarder with the base portion 41 and an abutting portion 42B bent inwardly at the front free end thereof. A cut-off groove 42C is formed at the edge of the abutting portion 42B. The two resilient arms 42 resiliently deformed vertically (a thicknesswise direction of the arm plane) around the base 41 working as a fulcrum when receiving the external force. The curved portion 42A promotes the resilient deformation by making long the arm length. The two resilient arms 42 are arranged at upper and lower positions of the shaft portion 36. The curved portion 42A and the abutting portion 42B are arranged at rear and forward positions with respect to the shaft portion 36, respectively.

As shown in FIGS. 1 and 2, the shutter 50 is made of a sheet metal and composed of the upper and lower shutter members 51 and 52. The shutter members 51 and 52 have a plane shape of C and comprise front lids 53 and 54 and rotating arms 55 and 56 extending backwardly from the ends of the lids 53 and 54, respectively. Although both the shutter members 51 and 52 have made almost symmetric vertically, the upper shutter member 51 is longer than the lower shutter member 52 by a dimension equal to a total thickness of the two rotating arms. Accordingly, the shutter members 51 and 52 are assembled such that the plane faces of the rotating arms 55 and 56 come in touch with each other. Since the both the shutter members 51 and 52 are symmetric vertically, only the upper shutter member 51 will be described below.

The lid 53 of the upper shutter member 51 moves only in the upper part of the opening surrounded by the upper and lower open-position stopping portions 32A and 32B and the left and right guide portions 33. In FIG. 5(A), the lid 53 has a slope 53A at the lower part thereof, which tilts toward the inside of the opening. The lid 53 has cut-off portions 53C and 53D at the sides thereof, from which the guide portion 33 of the shield case 30 projects forwardly, so that the guide portion 33 and the slope 53A work together to enable the plug-in of the mating connector.

The rotating arm 55 extending backwardly from the lid 53 has an arm curved downwardly and a hole 55A at the distal end of the arm. The hole has an internal diameter, which fits the shaft 36 provided in the shield case 31. The rotating arm 55 has flexibility in a thicknesswise direction of the arm plane so that when the rotating arm 55 is flexed outwardly by the external force, the shaft 36 is plugged in the hole 55A. Then, when the external force is removed, the shutter 50 is assembled with the shield case 30. The lower shutter member 52 is also assembled in the same way.

Figure 4:
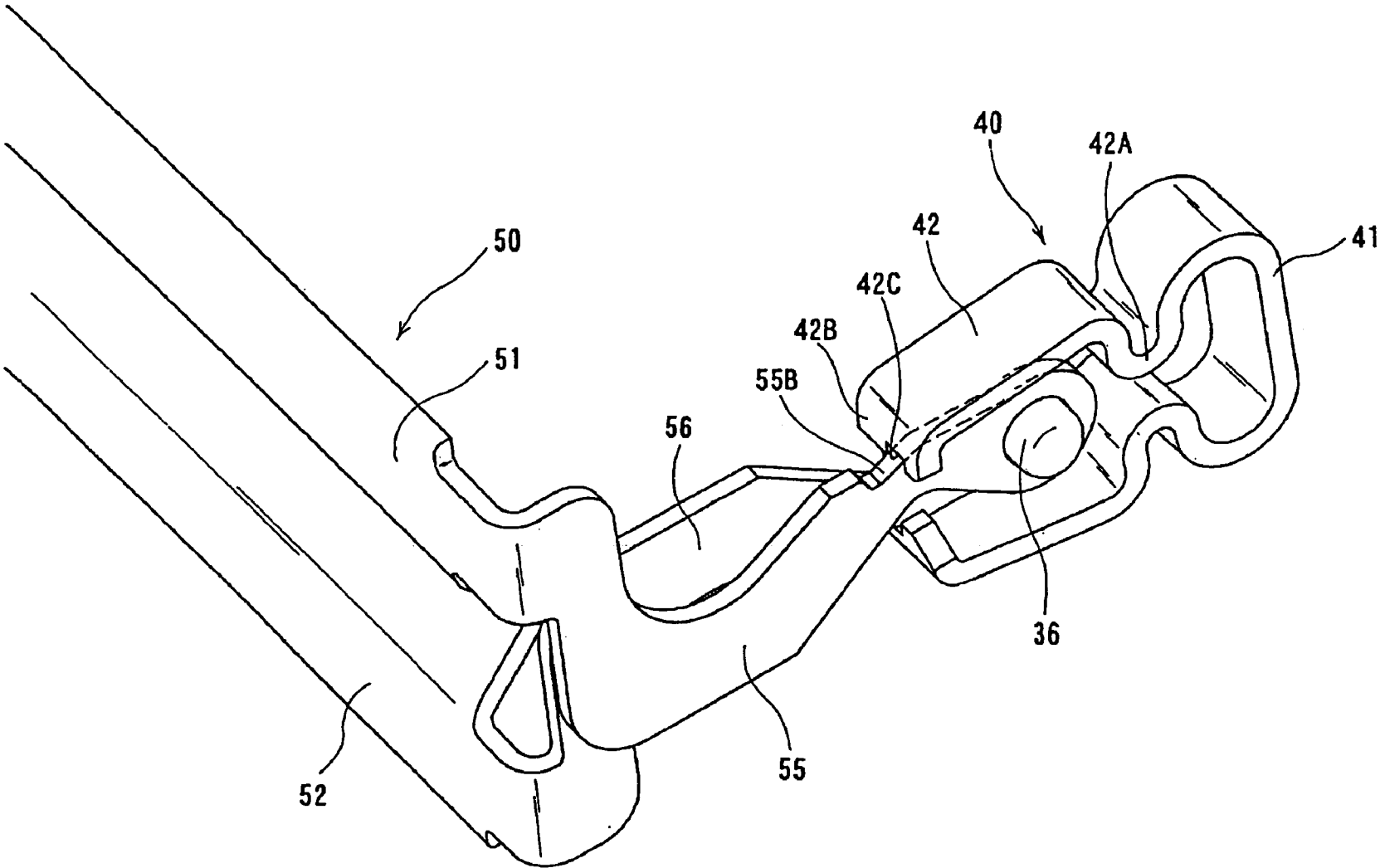
FIG. 4 is a perspective view of a shutter member and a resilient arm of the bias member of the electrical connector of FIG. 1.

As shown in FIG. 4, an abutted portion 55B is provided on the upper edge of the rotating arm 55, against which the abutting portion 42B of the resilient arm 42 abuts. When the abutted portion 55B receives resilience force from the abutting portion 42B of the resilience arm 42, the abutted portion 55B biases the shutter member 51 to rotatably move toward the closed position. The abutment position between the abutting and abutted portions 42B and 55B moves back and forth according to the rotating position of the shutter member 51. In this embodiment, the abutted portion 55B inclines toward the closed position of the shutter member 51 in the moving range of the abutment position.

Since the mating connector 60 shown in FIG. 1 is not a subject matter of the present application, only parts which relate to the connector 10 will be described briefly.

As shown in FIGS. 1 and 5(A), the mating connector 60 comprises a housing 61 and a shield case 62 covering a part of the housing 61, which is plugged in the connector 10. The housing 61 has a plurality of terminal grooves 64 arranged in a direction perpendicular to the sheet. A plurality of plate terminals 63 having a plate plane in parallel to the sheet are press-inserted into the terminal grooves 63 from the left. The terminal grooves 64 communicate to each other in the right thereof to form a space 65, which enters the arrangement portion 21B of the connector 10. Each of the terminals 63 has a contact portion 63A at the right end thereof positioned in the space 65 and a connection portion 63B at the right end thereof projecting and bent to the outside of the housing 61.

The shield case 62 has fixed legs 62A projecting to the left of the housing 61. When a circuit board P2 is placed to the left side of the housing 61, the fixed legs 62A are inserted into to corresponding grooves in the circuit board P2 and fixed to the grooves by soldering or other means. The connection portion 63B is also connected to a corresponding circuit portion in the circuit board P2 by soldering or other means.

The housing 61 comprises guide projections 66 provided on both sides thereof in a terminal arrangement direction and projecting toward the connector 10. The guide projections 66 push the slopes 53A and 54B of the upper and lower shutter members 51 and 52 to open the upper and lower shutter members 51 and 52 upwardly and downwardly, respectively. The guide projections 66 also abut against the guide portions 33 of the connector 10 to perform the right plug-in positioning between both the connectors 10 and 60 in the terminal arrangement direction. Two slits are provided in the upper face of the shield case 62 so that protrusions 61A provided on the upper face of the housing 61 engage the slits. The protrusions 61A are guided by the guide groves 37 of the connector 10 when the connector 60 is plugged in the connector 10.

Figure 6B:
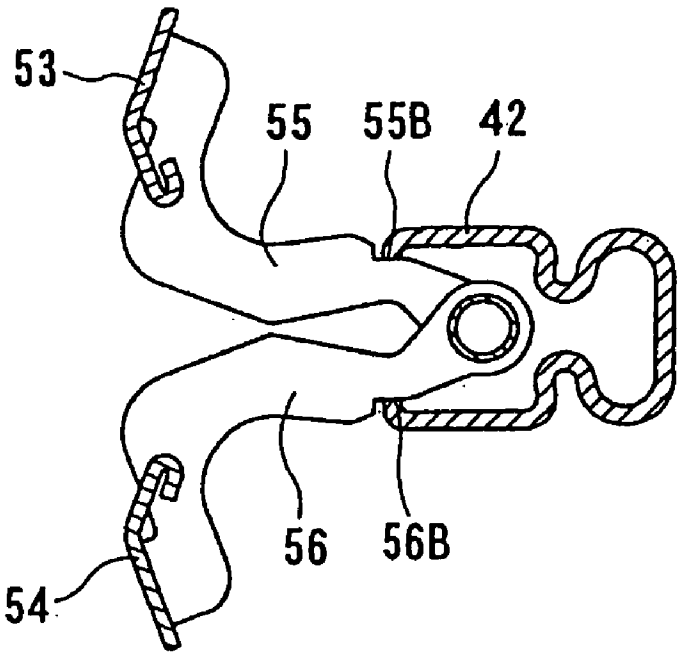
FIGS. 6(A) and 6(B) are sectional views of the shutter members and the resilient arm of the bias member of the electrical connector of FIG. 1 in the states of a closed position and an open position of the shutter, respectively.
Figure 6A:
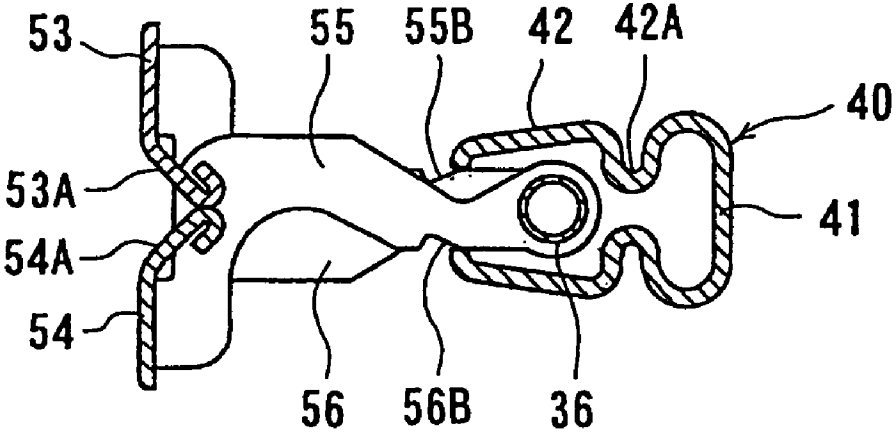

The open and closed operations of the shutter 50 (shutter members 51 and 52) during the plug-in between the connectors 10 and 60 will be described with reference to FIGS. 5 and 6. FIG. 6 illustrates only the shutter members 51 and 52 and the resilient arm 42 of the bias member 40.

(1) The electrical connector 10 is fixed to a circuit board P1 and the mating connector 60 is fixed to the circuit board P2. When the rotating arms 55 and 56 are pushed by the resilient arm 42 of the bias member 40, corresponding edges of the slopes 53A and 54A of the lids 53 and 54 abut against each other so that the upper and lower shutter members 51 and 52 close the opening of the connector 10. The shutter members 51 and 52 stay stably at the closed position even if excessive external force is applied, the side edges of the lids 53 and 54 abut against the closed position control portion 33A and 33B of the guide portion 33 of the shield case 30, respectively. Accordingly, the mating connector 60 is guided and connected smoothly.

(2) When the mating connector 60 is plugged in the connector 10, the guide projections 66 abut against the slopes 53A and 53B of the lids 53 and 54 so that the shutter members 51 and 52 rotate upwardly and downwardly toward the open position. Since the rotating arms 55 and 56 of the shutter members 51 and 52 are biased toward the closed position by the resilient arms 42, even when the lids 53 and 54 are opened to accept the entering of the mating connector 60, the corresponding edges of the lids 53 and 54 keep contact with the shield case 62 of the connector 60 during the entering of the connector 60. The connector 60, which is charged with static electricity, is grounded to the circuit board through the upper and lower shutter members 51 and 52, and bias members 40 and fixed legs 35 of the shield case 30. Similarly, the connector 60 is grounded by touching the lids directly by a finger. The corresponding edges abut against the open position control portions 32A and 32B to prevent an excessive opening of the shutter members 51 and 52.

(3) While the shutter members 51 and 52 are rotating toward the open position, the abutment position of the abutting portion 42B of the resilient arm 42 with the abutted portion 55B of the rotating arm 55 of the shutter member 51 moves forwardly in the range of the abutted portion 55B as the shutter members 51 and 52 open wider and wider. Since the abutted portion 55B inclines toward the closed position of the shutter members, even while the open degree of the shutter member 51 increases, the resilient deformation of the resilient arm 42 does not increase or seldom increases. Accordingly, since the resilient arm 42 does not receive an excessive stress, the resilient arm 42 does not produce plastic deformation.

(4) When the mating connector 60 enters the connector 10 up to a predetermined position, the contact portion 63A of the terminal 63 of the connector 60 is brought into resilient contact with the contact portion 22A of the terminal 22 of the connector 10, thus both the connectors 10 and 60 are electrically connected. That is, both the circuit boards P1 and P2 are connected.

(5) When the mating connector 60 is removed from the connector 10, the shutter members 51 and 52 return to the original closed position automatically by the bias force of the resilient arm 42, thus the opening of the connector 10 is closed.

Second Embodiment

Figure 7B:
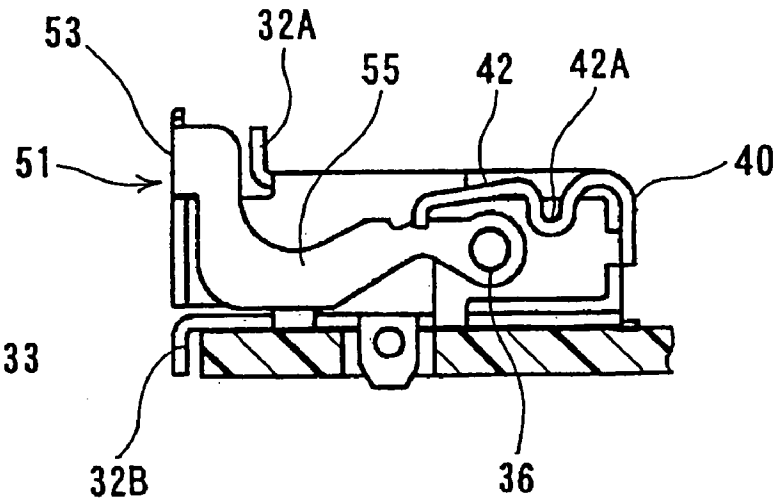
FIGS. 7(A) and 7(B) are a front view and a side view of an electrical connector according to the second embodiment of the present invention, respectively.
Figure 7A:
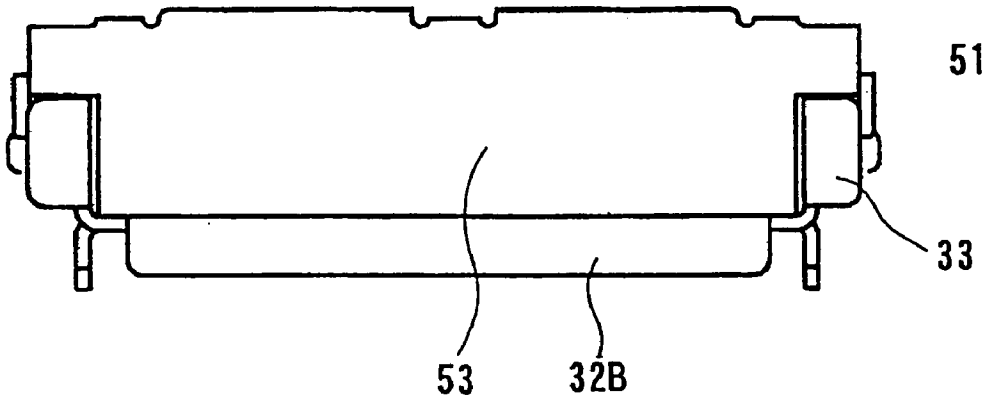

In the second embodiment, modifications of the first embodiment will be described. In the first embodiment, two shutter members are provided symmetrically in the vertical direction. However, either of the two shutter members, for example, as shown in FIG. 7, only an upper shutter member 51 is provided. In FIG. 7, the same reference numerals are used for the common members or parts used in the first embodiment. In the second embodiment, since there is only the upper shutter member 51, which opens upwardly, only a resilient arm 42 is necessary, which is provided on the upper side. In this case, the vertical width of a lid 53 of the shutter member 51 is twice as large as that of the lid 53 in the first embodiment.

Third Embodiment

In the first embodiment, the resilient arm of the bias member is integrally made with the shield case. However, the bias member may be provided separately from the shield case or even no shield case may be needed in the present invention.

Figure 8:
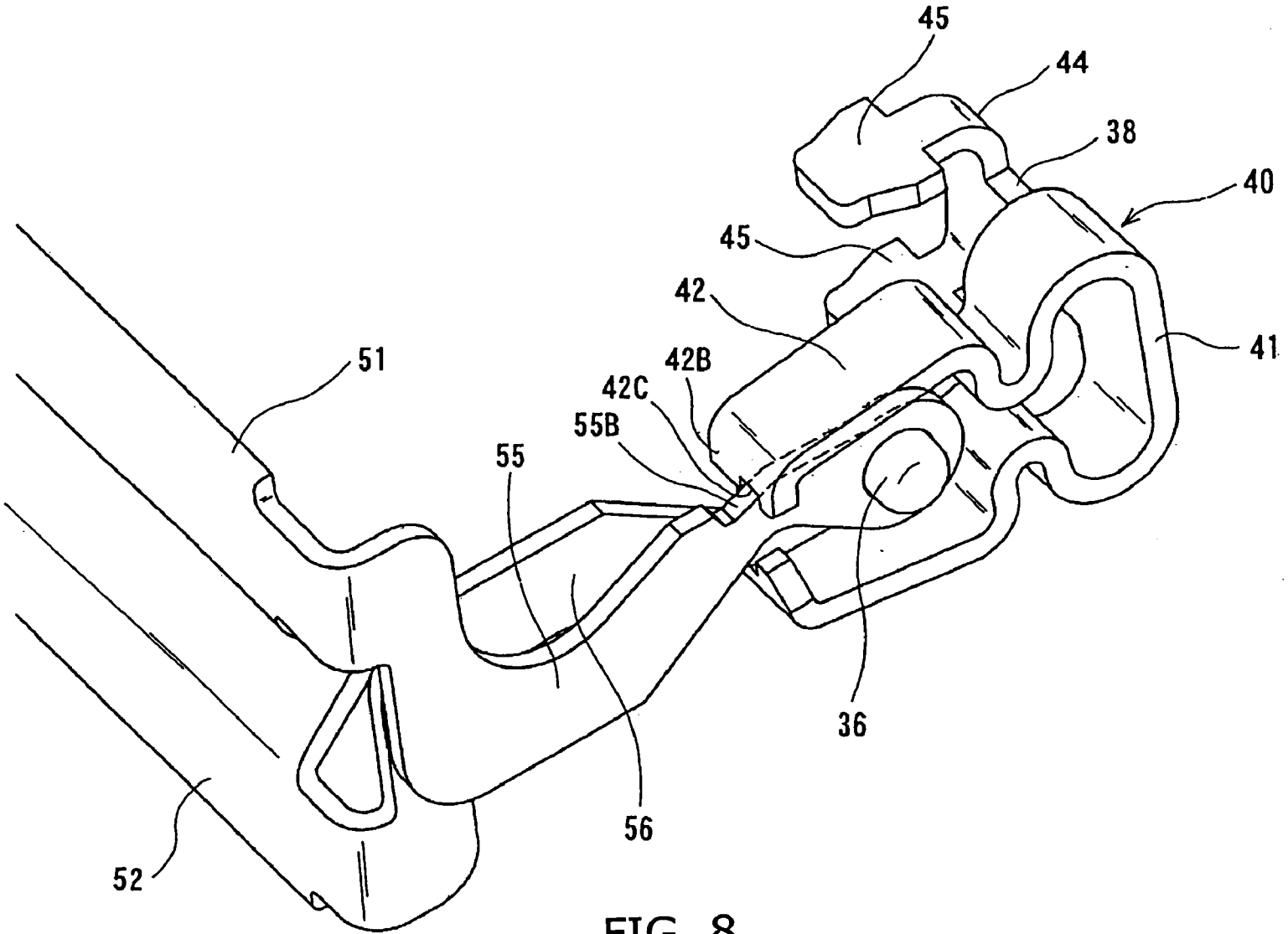
FIG. 8 is a perspective view of a bias member and shutter members according to the third embodiment of the present invention.

In FIG. 8, a bias member 40 comprises a fixed portion 44 through a connection portion 38. The resilient arm 42 and the shutter members 51 and 52 are same as those in the first embodiment and the explanation thereof will be omitted.

The bias member 40 comprises a base portion 41, the connection portion 38 extending from the base portion 41, and the fixed portion 44 connected to the connection portion 38, which are all integrally formed. The fixed portion 44 is bent in a shape of C and has two fixed pieces 45 provided in parallel to each other. The fixed pieces 45 are tapered toward the front end thereof and press-inserted into, for example, corresponding grooves in the form of a slit provided in the housing. The shape of the fixed portion 44 is not limited to this example and the fixed portion 44 may extend along and in parallel to the side wall of the housing. In the third embodiment, although the fixed portion 44 is fixed to the housing, it may be fixed to the shield case.

Also, the shaft 36, which rotatably supports the rotating arms 55 and 56 of the shutter members 51 and 52, may be formed by a part extending from the fixed portion 44 or a pin driven into the housing.

The invention claimed is:

1. An electrical connector having a shutter at an opening provided on a front side thereof for plug-in with a mating connector, said electrical connector comprising:

a housing;

a shield case made of a sheet metal and fixed to an outside of said housing;

at least one shutter member for opening and closing said opening of said electrical connector and having a lid moving to an open position of said shutter when said mating connector pushes said lid during said plug-in; and a pair of bias members for biasing said shutter member toward a closed position of said shutter, wherein each of said pair of bias members includes at least one resilient arm of a plate-type spring made as one body with said shield case, wherein said resilient arms extend forwardly along both side walls of said housing from an rear end of said shield case through connection portions, and said shutter member comprises said lid provided at a position corresponding to said opening and a pair of rotating arms extending backwardly along said side walls of said housing from both sides of said lid, each of said rotating arms being rotatably supported by a rotation support portion provided on said housing or said shield case, and wherein an abutting portion provided at a free end or in the vicinity of said free end of said resilient arm abuts against said rotation arm at a forward position of said rotation support portion to bias said rotation arm to said closed position.

2. The electrical connector according to claim 1, wherein said abutting portion of said resilient arm has a cut-off groove and said rotation arm of said shutter member has an abutted portion on an upper or a lower edge thereof such that said abutted portion is put in said cut-off groove to prevent a shift of said rotation arm in a side direction with respect to a rotation plane of said rotation arm.

3. The electrical connector according to claim 1, wherein said resilient arm comprises a curved portion, which is curved in a thicknesswise direction of said resilient arm to promote a resilient flexibility of said resilient arm.

4. The electrical connector according to claim 2, wherein said rotation arm has a slope inclining toward said closed position of said shutter in a range where said abutting portion abuts against said abutted portion during a rotation of said rotation arm.

5. The electrical connector according to claim 1, wherein said shield case has guide portions extending forwardly and then inclining outwardly, and said lid of said shutter member has a slope tilting toward an inside of said opening and cut-oft portions provided on sides thereof, said guide portions projecting from said cut-off portions forwardly so that said guide portions and said slope work together for guiding said mating connector to be plugged in said electrical connector at said closed position of said shutter.

6. The electrical connector according to claim 1, wherein said housing or said shield case comprises at least one open position control portion to control a maximum opening degree of said shutter member.

7. The electrical connector according to claim 1, wherein said housing or said shield case comprises at least one closed position control portion to abut against said shutter member to fix said closed position of said shutter member.

8. The electrical connector according to claim 1, wherein said shutter member is made by processing a sheet metal.

9. The electrical connector according to claim 1, wherein only one said shutter member is provided and each of said pair of bias members has only one said resilient arm to bias said shutter member.

10. The electrical connector according to claim 1, wherein two said shutter members are provided and oppose to each other during a rotation of said shutter members and each of said pair of bias members has two said resilient arms to bias corresponding one of said shutter members.

11. An electrical connector having a shutter at an opening provided on a front side thereof for plug-in with a mating connector, said electrical connector comprising:

a housing;

a shield case made of a sheet metal and attached to an outside of said housing;

at least one shutter member for opening and closing said opening of said electrical connector and having a lid moving to an open position of said shutter when said mating connector pushes said lid during said plug-in; and a pair of bias members for biasing said shutter member to a closed position of said shutter, wherein each of said pair of bias members includes a fixed portion fixed to a housing or to a member fixed to said housing, and at least one resilient arm of a plate-type spring made as one body with said fixed portion, said resilient arm extending forwardly along a side wall of said housing, said shutter member having a rotating arm extending backwardly along said side wall of said housing and rotatably supported by a rotation support portion that is provided on said housing or said shield case, and an abutting portion provided at a free end or in the vicinity of said free end of said resilient arm abuts against said rotation arm at a forward position of said rotation support portion to bias said rotation arm to said closed position.

* * * * *